US005096189A

United States Patent [19]

Beasley

[11] Patent Number: 5,096,189

[45] Date of Patent: Mar. 17, 1992

[54] AQUATIC EXERCISE DEVICE

[76] Inventor: Robert Beasley, 1217 Terra Mar Dr., Tampa, Fla. 33613

[21] Appl. No.: 623,786

[22] Filed: Dec. 7, 1990

Related U.S. Application Data

[62] Division of Ser. No. 433,280, Nov. 8, 1989, abandoned.

[51] Int. Cl.[5] ..... A63B 21/00

[52] U.S. Cl. ..... 272/116; 272/71; 434/254; 441/61

[58] Field of Search ..... 272/1 B, 71, 96, 116, 272/119, 130; 441/59-64; 434/254

[56] References Cited

U.S. PATENT DOCUMENTS

| | | | |
|---|---|---|---|
| 3,913,907 | 10/1975 | Baker | 272/71 X |
| 4,300,759 | 11/1981 | Caplan | 272/116 |
| 4,411,422 | 10/1983 | Solloway | 272/96 |
| 4,509,744 | 4/1985 | Beasley | 272/116 |
| 4,721,300 | 1/1988 | Guzman | 272/116 |
| 4,813,668 | 3/1989 | Solloway | 272/116 |
| 4,858,913 | 8/1989 | Stuart | 434/254 X |
| 4,932,911 | 6/1990 | Albrecht | 272/71 |

FOREIGN PATENT DOCUMENTS

| | | | |
|---|---|---|---|
| 931201 | 6/1982 | U.S.S.R. | 272/71 |

*Primary Examiner*—Robert Bahr
*Attorney, Agent, or Firm*—Frijouf, Rust & Pyle

[57] ABSTRACT

An aquatic exercise device for a user immersed in water comprising a restraining member having a top surface and a bottom surface with the restraining member defining a front portion, an intermediate portion and a rear portion. A flotation means is affixed to the restraining member. The restraining member is secured to each foot of a user to enable the user immersed in water to exercise in the water with the restraining member to inhibiting the foot movement of the user and with the flotation means to partially supporting the user in the water.

5 Claims, 5 Drawing Sheets

AQUATIC EXERCISE DEVICE

This is a continuation of application Ser. No. 433,280 filed Nov. 8, 1989, now abandoned, the disclosure of which is incorporated herein by reference.

BACKGROUND OF THE INVENTION

1. Field of the Invention

This invention relates to exercise devices and more particularly, to devices for exercising in a water medium.

2. Information Disclosure Statement

Various types of apparati and devices have been proposed in the prior art for assisting in personal exercise. These prior art apparati and devices range from free-weights to various types and designs of exercise machines. Many of the prior art exercise machines incorporate a wide variety of multiple features for developing or exercising various parts of the body.

As the trend for exercising increases within the United States, more research is being performed on the benefits and detriments of the various types of exercises and exercising techniques. For example, many exercise experts believe that prolonged running on hard pavement results in a detrimental effect on various bones, ligaments and the like. Furthermore, many exercise machines such as free-weights may be dangerous if the operator is not accompanied by an assistant.

One of the safest forms of exercise heretofore utilized in the prior art is aquatic exercise. First, in an aquatic exercise, the resistance to motion is supplied only by the viscosity of water and therefore the danger of large weights is totally eliminated in aquatic exercise. Second, aquatic exercise tends to exercise almost all body muscles in contrast to other exercise forms which tend to concentrate on limited muscle groups. Accordingly, aquatic exercise has been considered by many to be the most balanced of all exercise forms.

In some cases, elderly or over-weight have difficulty with conventional forms of exercise. Aquatic exercise is particularly beneficial to elderly or overweight people since the water provides a natural buoyancy for the body. Consequently, a person exercising in water does not have to support their entire body weight during the exercise process.

Many in the prior art have realized the benefits of aquatic exercise and have proposed various types of devices for enhancing the aquatic exercise process by increasing the resistance to motion within the water. The prior art has provided various devices for attachment to the hand of a person. These prior art patents include U.S. Pat. Nos. D-196,689; 1,062,587; 1,546,670; 1,715,571; 1,754,704; 2,389,196; 4,458,896; 4,623,142 and 4,819,951 which illustrate diverse devices for attaching to the hand during aquatic use. In addition, the prior art has provided various devices for attachment to the foot of a person. These prior art patents include U.S. Pat. Nos. 3,146,470 and 4,632,387. U.S. Pat. No. 3,734,493 illustrates a device that is affixable to either a hand or a foot of a person. U.S. Pat. No. 1,517,930 to Jacobsen discloses a variable resistance swimming training device for retarding the forward motion of a swimmer.

Although various types of devices have been proposed by the prior art regarding swimming aids, it is a primary object of the present invention to provide a superior apparatus for an improved aquatic exercise device for securing to a foot of a user immersed in water for inhibiting the foot movement of the user and including flotation means to partially support the user in the water.

Another object of this invention is to provide an aquatic exercise device for inhibiting the foot movement of a user whereby a user may walk, jog or run while immersed within water to obtain superior exercise results compared to conventional walking, jogging or running.

Another object of this invention is to provide an improved aquatic device for securing to a foot of a user which is light-weight and easy to manufacture at a reasonable cost.

Another object of this invention is to provide an improved aquatic device for securing to a foot of a user wherein the device may be used within a conventional swimming pool or may be used within seawater.

Another object of this invention is to provide an improved aquatic device for securing to a foot of a user wherein the buoyancy of the device may be altered depending upon whether the device is used in freshwater or is used in seawater and depending upon the buoyancy or exercise ability of the user.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full under standing of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an apparatus and method is disclosed for an improved aquatic exercise device for a user immersed in water comprising a restraining member having a top surface and a bottom surface with the restraining member defining a front portion, an intermediate portion and a rear portion. A flotation means affixed to the restraining member. The restraining member is secured to a foot of a user to enable the user immersed in water to exercise with the restraining member inhibiting the foot movement of the user and with the flotation means partially supporting the user in the water.

In a more specific embodiments of the invention, the restraining member is a substantially flat one piece member formed from a polymeric material. In one embodiment of the invention, the front portion of the restraining member is enlarged and forms an angle relative to the intermediate portion of the restraining member.

In one embodiment of the invention, the flotation means comprises a closed cell foam material and is secured to the bottom surface of the restraining member. The flotation means may include an intermediate floatation portion and a rear floatation portion with a forward edge of the intermediate floatation being inclined toward the restraining member. The intermediate flotation portion is substantially flat and has the general shape of the intermediate portion of the restraining member. In a similar manner, the rear flotation portion is substantially flat and having the general shape of the rear portion of the restraining member. An intermediate securing means and a rear securing means for respectively securing the intermediate portion and the rear portion of the floatation means to the restraining member and for enabling each of the intermediate portion and the rear portion of the floatation means to be independently removed from the restraining member.

The restraining member is secured to a foot of a user by a foot harness affixed to the restraining member. The foot harness extends through an aperture means in the restraining member for securing the foot harness to the restraining member.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several figures of the drawings.

DETAILED DISCUSSION

Figure 1:
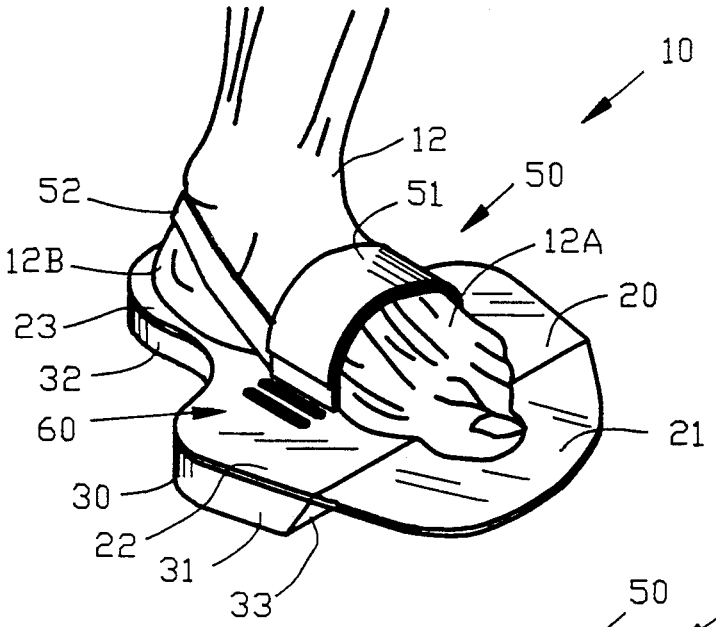
FIG. 1 is an isometric view of a first embodiment of the improved aquatic exercise device of the present invention.
Figure 2:
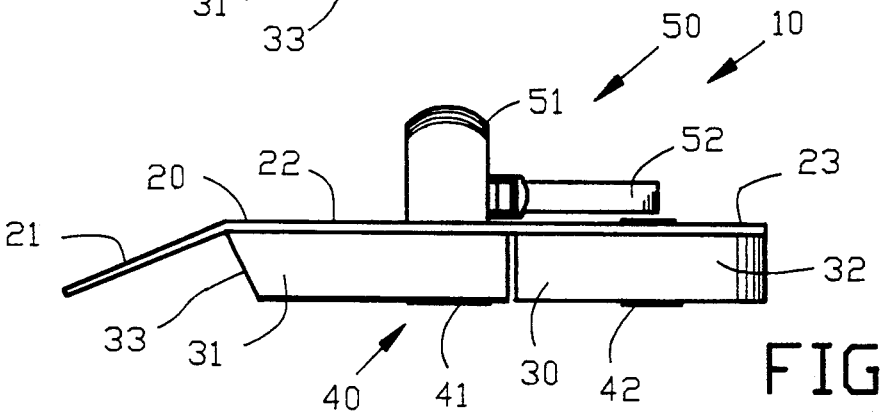
FIG. 2 is a side elevational view of the first embodiment of the aquatic exercise device of FIG. 1.
Figure 3:
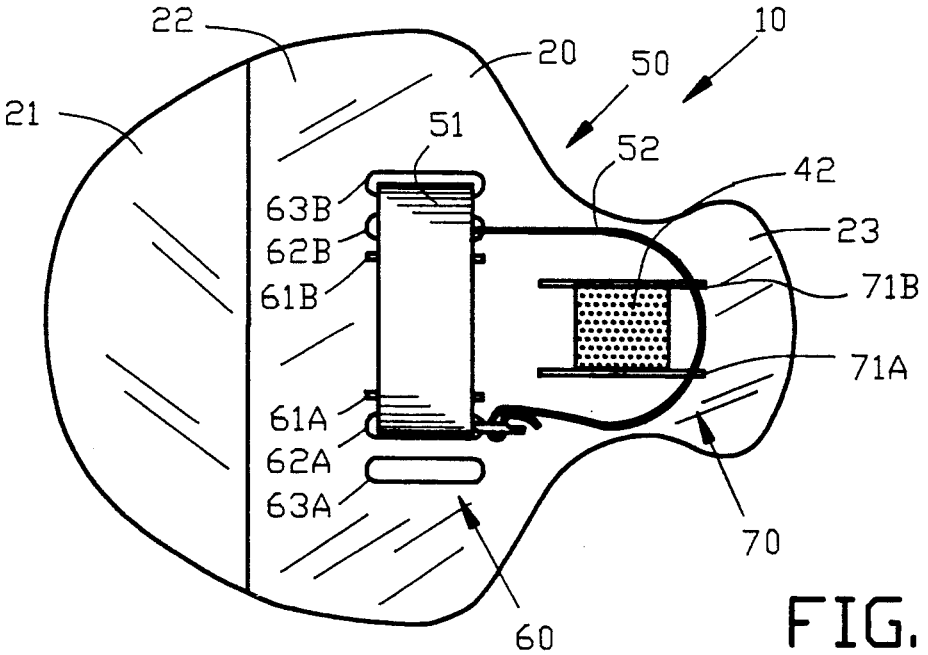
FIG. 3 is a top view of the first embodiment of the aquatic exercise device of FIG. 2.
Figure 4:
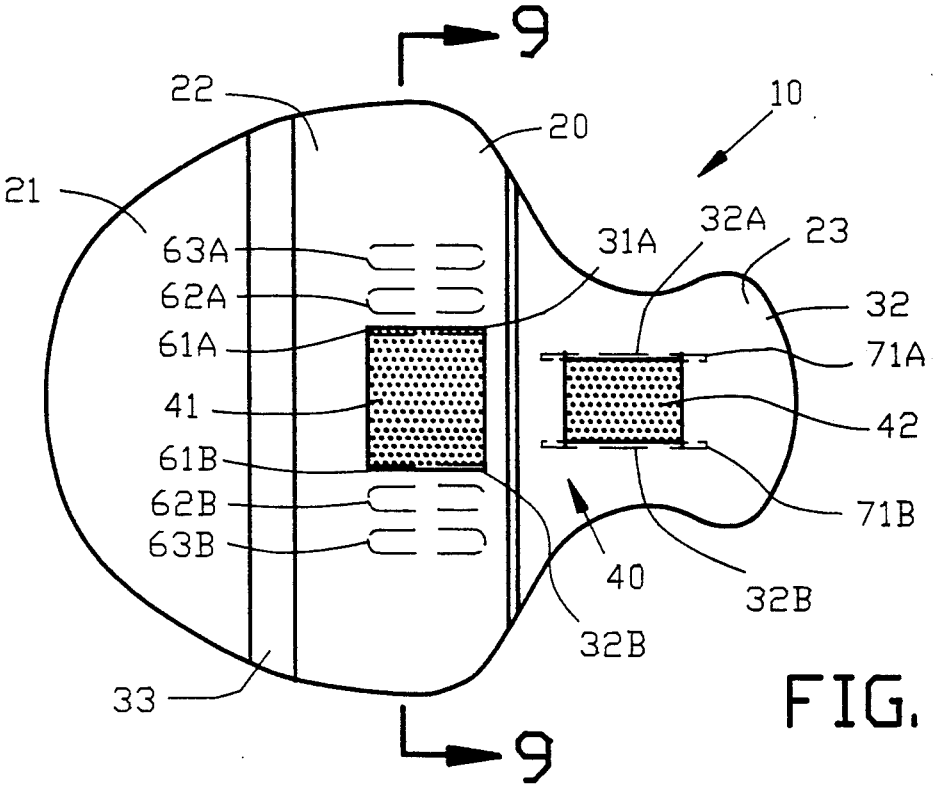
FIG. 4 is a bottom view of the first embodiment of the aquatic exercise device of FIG. 2.
Figure 5:
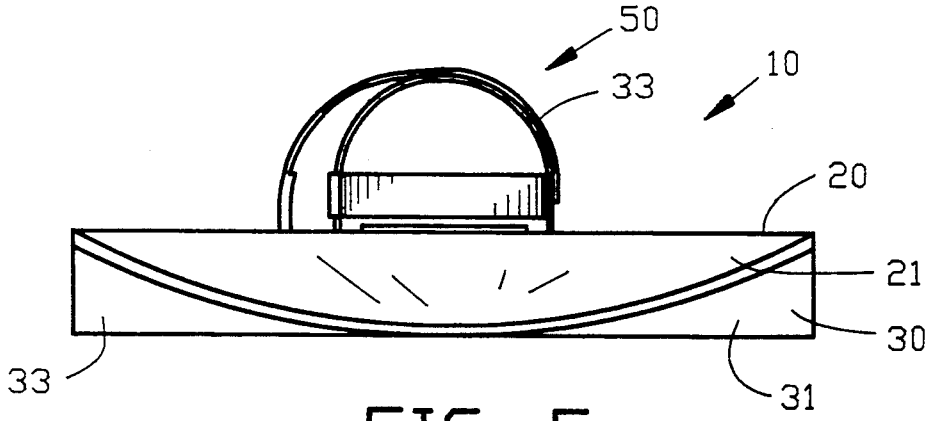
FIG. 5 is a front elevational view of the first embodiment of the aquatic exercise device of FIG. 2.

FIG. 1 is an isometric view of an improved aquatic exercise device 10 secured to a foot 12 of a user and adapted to be used when the user 12 is immersed in water. The improved aquatic exercise device 10 comprises a restraining member 20 defining a front portion 21, an intermediate portion 22 and a rear portion 23. FIG. 2 is a left side elevational view of the aquatic device 10 shown in FIG. 1 whereas FIGS. 3 and 4 are a top plan view and a bottom plan view of the aquatic device 10, respectively. FIG. 5 is a front elevational view thereof.

The aquatic exercise device 10 includes flotation means 30 shown as a first and a second flotation means 31 and 32 in FIGS. 2 and 4. The flotation means 30 is secured to the restraining member 20 by floatation securing means 40 shown as a first and second securing means 41 and 42 shown as nylon straps for respectively securing the first and second flotation means 31 and 32 to the restraining member 20. The aquatic device 10 includes foot securing means 50 for securing the restraining member 20 to the foot 12 of the user for enabling the restraining member 20 to restrain the foot movement of the user with the flotation means 30 partially supporting the user when the user is immersed in water. In this embodiment, the foot securing means comprises a first and a second foot securing means 51 and 52 with the first foot securing means 51 extending over the instep 12A of the foot 12 whereas a second foot securing means 52 extends about the heel 12B of the foot 12.

The restraining member 20 is shown in the first embodiment of the invention as being a substantially flat one-piece member formed of an unitary polymeric material such as polypropylene having a thickness of one eight of an inch. The front portion 21 of the restraining member 20 preferably forms an angle relative to the intermediate portion 22 of the restraining member 20. In this embodiment, the front portion 21 forms an angle of approximately twenty (20) degrees relative to the intermediate portion 22 for enabling the return stroke of the restraining member 20 after a downward stroke by a user. The front portion 21 and intermediate portion 22 are enlarged relative to the rear portion 23.

As best shown in FIGS. 3 and 4, the restraining member 20 includes a plurality of through apertures 60 defined in the intermediate portion 22 of the restraining member as well as a plurality of apertures 70 defined in the rear portion 23 of the restraining member 20. The intermediate apertures 60 comprise inner elongated apertures 61A and 61B, central elongated apertures 62A and 62B and outer elongated apertures 63A and 63B. The rear portion 23 of the restraining member comprises aperture 71A and 71B which are elongated in a manner similar to the inner aperture 61A and 61B. A first flotation securing means 41 shown as a strap extends through inner apertures 61A and 61B through apertures 31A and 31B defined in the first flotation means which are located in registry with the inner apertures 61A and 61B respectively. The first flotation securing means 41 extends through the intermediate inner apertures 61A and 61B and through the first flotation apertures 31A and 31B to affix the first flotation means 31 to the bottom surface 26 of the restraining member 20. In a similar manner, the second flotation means 32 includes second flotation apertures 32A and 32B which are located in registry with the rear apertures 71A and 71B of the rear portion 23 of the restraining member 20. The second flotation securing means 42 shown as a strap extends through the rear aperture 71A and 71B and the second flotation apertures 32A and 32B to affix the second flotation means 42 to the bottom surface 26 of the restraining member 20. Preferably, the first and second flotation securing means 41 and 42 comprise nylon straps to secure the first and second flotation means 31 and 32 to the restraining member 20 by means such as snaps, buckles or hook and loop devices commonly sold under the trademark VELCRO.

Figure 6:
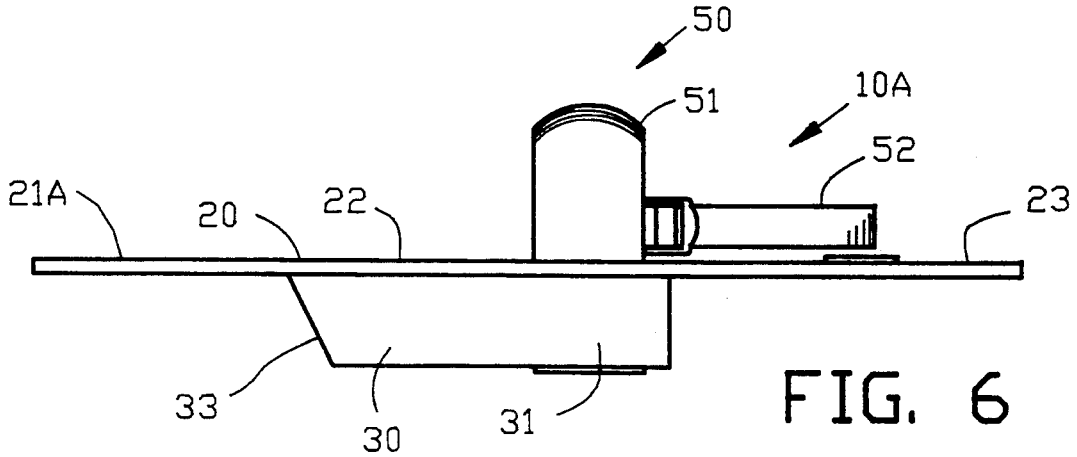
FIG. 6 is a side elevational view of the first embodiment of an aquatic exercise device with an alternate floatation arrangement.

In this embodiment, the flotation means 30 has been shown as a first and a second flotation means 31 and 32, but it should be understood that the first and second flotation means 31 and 32 may be formed as an integral unit. The advantage of separating the flotation means 30 into a plurality of flotation means such as the first and second floatation means 31 and 32, enables the user to adjust the buoyancy of the aquatic exercise device 10 by removing one or more of the flotation means. For example in FIG. 6, the second flotation means 32 has been removed leaving only the first flotation means 31. Although many types of materials may be used for the floatation means 30, a closed cell polyethylene foam having a thickness of one inch has been found to be suitable for use with the present invention.

Figure 7:
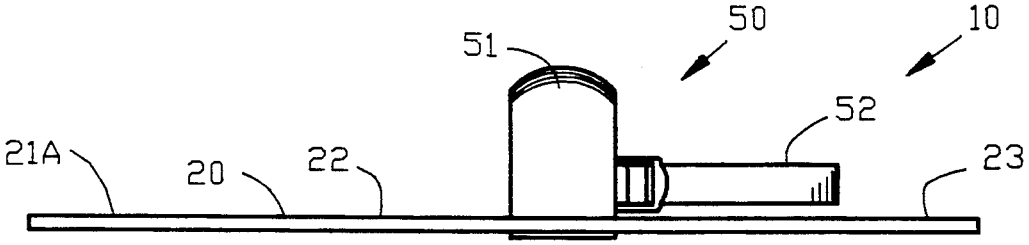
FIG. 7 is a side elevational view of a variation of the first embodiment of an aquatic exercise device with the floatation being removed.

FIG. 7 is a side elevational view of a variation of the first embodiment of an aquatic exercise device 10. In this embodiment, the front portion 21A extends parallel to the intermediate portion 22 and the rear portion 23 of the restraining member 20 to form a planar surface. Both the first and second flotation means 31 and 32 have been removed for minimizing the flotation effect of the aquatic exercise device 10.

Figure 8:
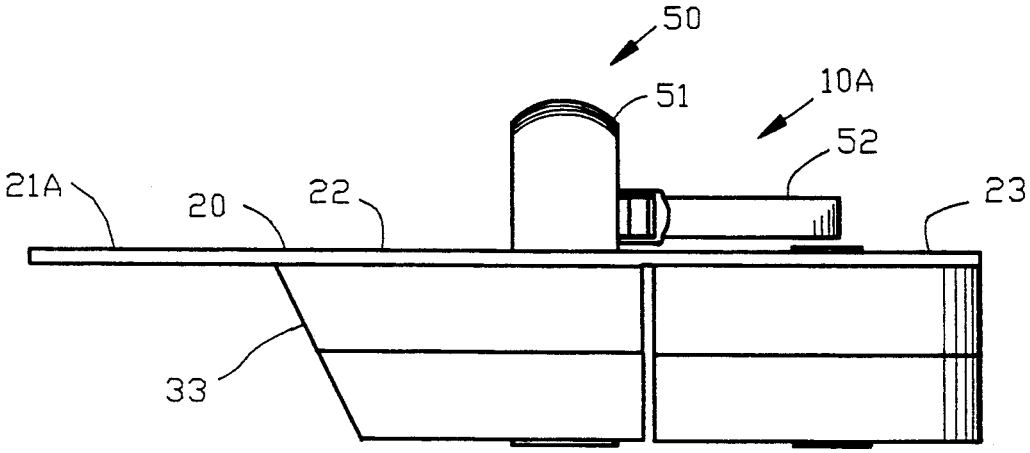
FIG. 8 is a side elevational view of the aquatic exercise device of FIG. 7 with multiple layers of floatation.

FIG. 8 is a side elevational view of the aquatic exercise device of FIG. 7 with a first and second flotation means 31 as 32 well as a third and a fourth flotation means 33 and 34. The third and fourth flotation means 33 and 34 are secured to the restraining member 20 in a manner similar to the first and second flotation means 31 as 32. The multiple layers of floatation means provides addition flotation support for the user.

Figure 9:
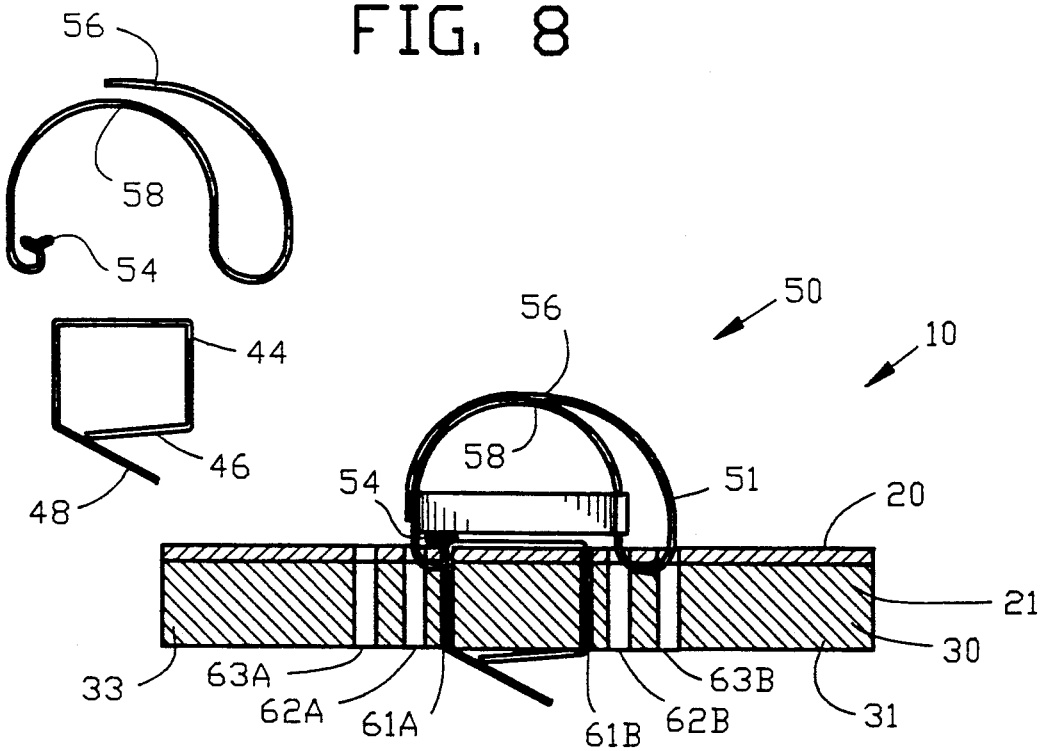
FIG. 9 is an enlarged sectional view of a portion of the first embodiment of an aquatic exercise device illustrating the interconnection of floatation securing means and foot securing means.

FIG. 9 is an enlarged partial sectional view showing in greater detail the flotation securing means 40 and the foot securing means 50. The first floatation securing means 41 of the flotation means 30 is shown as nylon strap 44 with a first end 46 and a second end provided with fasteners commonly sold under the trademark VELCRO. Preferably, VELCRO loop are disposed on the first end 46 and VELCRO hooks are disposed on the second end 48 of the nylon strap 44. The nylon strap 44 extends through inner aperture 61A and 61B and encircles the first floatation means 31. The VELCRO loop on the first end 46 engage with the VELCRO hooks on the second end 48 of the nylon strap 44 for securing the flotation means 30 to the restraining member 20.

The foot securing means 50 preferably comprises a first strap 51 extending through the central aperture 62A and 62B of the restraining member 20 for extending over the instep 12A of the foot 12. Preferably, the first strap 51 comprises a nylon strap which is secured to the instep 12A of the foot 12 by means such as snaps, buckles or VELCRO fasteners.

The first strap 51 includes an enlarged end 54 disposed on an upper surface of the restraining member 29. The first strap 51 extends through inner aperture 61B and passes along the underside of the restraining member 20 to extend outwardly from central aperture 62B. The first strap 51 extending over the instep 12A of the foot 12 and enters central aperture 62A. The first strap 51 passes along the underside of the restraining member 20 to extend outwardly from the outer aperture 63A. Preferably, an end 56 and an intermediate portion of the first strap 51 is provided with VELCRO fasteners.. The end 56 is provided with VELCRO loop for engaging with VELCRO hooks disposed on the intermediate portion 58 of the first strap 51 for securing the end 56 to the intermediate portion 58 of the first strap 51 as shown in FIG. 9.

The second foot securing means 52 is mounted to the first foot securing means 51 and extends about the heel 12B of the foot 12. The second foot securing means 52 may be mounted to the first foot securing means 51 by sewing, rivets and the like or may be in the form of a loop extending about the first foot securing means 51. Preferably, the second strap 52 comprises a nylon strap which is secured about the heel 12B of the foot 12 by means such as snaps, buckles or VELCRO fasteners. The foot securing means 50 may be used either with a bare foot or a foot wearing a shoe or the like. The foot securing means may also be in the form of a shoe or boot permanently affixed to the restraining member 20 or may be in the form of a water ski boot or the like.

Figure 10:
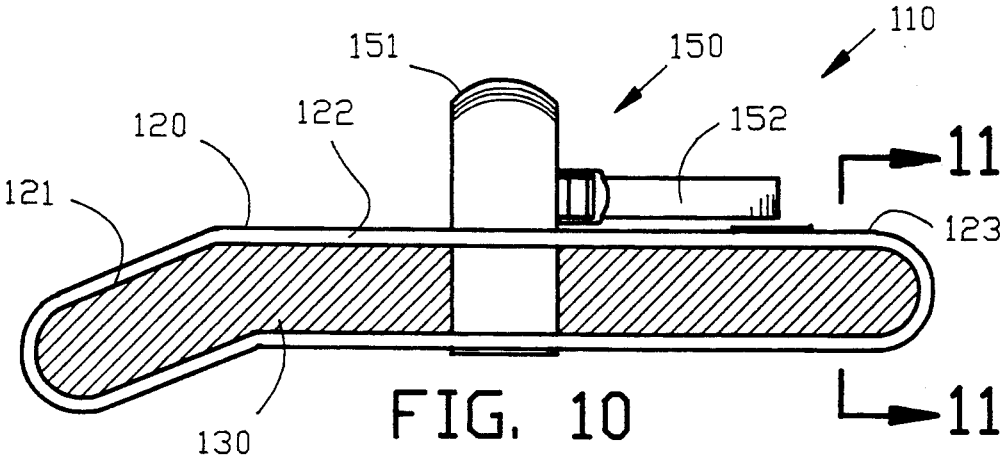
FIG. 10 is a side sectional view of a second embodiment of an aquatic exercise device of the present invention.
Figure 11:
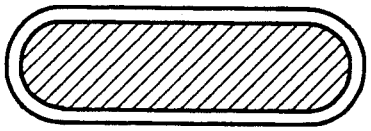
FIG. 11 is a sectional view along line 11—11 of FIG. 10.

FIG. 10 is a sectional view of a second embodiment of an aquatic exercise device 110 of the present invention. FIG. 11 is a sectional view along line 11—11 of FIG. 10. The aquatic exercise device 110 comprises a restraining member 120 defining a front portion 121, an intermediate portion 122 and a rear portion 123. The aquatic exercise device 110 includes flotation means 130 shown as a first, second and a third flotation means 131, 132 and 133. The flotation means 130 is disposed within the restraining member 120. In this embodiment, the restraining member 120 comprises an outer skin formed of an unitary polymeric material such as polyethylene or ABS plastic having a thickness of one eight of an inch. Preferably, the restraining member 120 is molded about the floatation means 130 which may be in the form of a closed cell polyethylene foam having a thickness of one inch. The front portion 121 of the restraining member 120 preferably forms an angle relative to the intermediate portion 122 of the restraining member 120. In this embodiment, the front portion 121 forms an angle of approximately twenty (20) degrees relative to the intermediate portion 122. The front portion 121 and intermediate portion 122 are enlarged relative to the rear portion 123 in a manner similar to the shape of the first embodiment of the aquatic exercise device 10 shown in FIGS. 1–9.

The aquatic device 110 includes foot securing means 150 for securing the restraining member 120 to the foot 12 of the user. The foot securing means 150 comprises a first and a second foot securing means 151 and 152 with the first foot securing means 151 extending over the instep 12A of the foot 12 whereas a second foot securing means 152 extends about the heel 12B of the foot 12. The first and second foot securing means 151 and 152 are similar to the arrangement shown in FIGS. 1-9.

Although the aquatic exercise device 110 of FIGS. 10 and 11 is not capable of changing the amount of the floatation or buoyancy of the aquatic exercise device 110, the aquatic exercise device 110 encloses the flotation means 130 within the restraining member 120. Accordingly, the restraining member 120 forms an protective outer skin of a durable polymeric material for the less durable floatation means 130.

Figure 12:
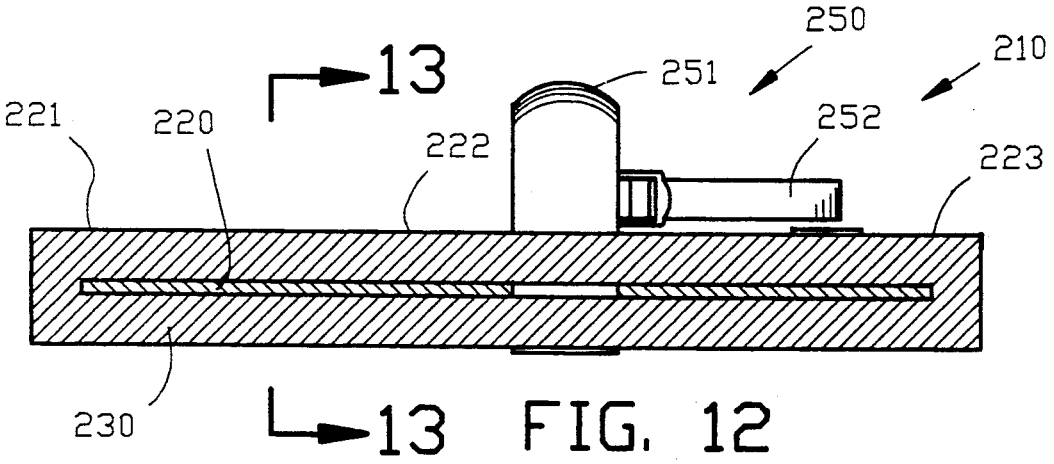
FIG. 12 is a side sectional view of a third embodiment of an aquatic exercise device of the present invention.
Figure 13:
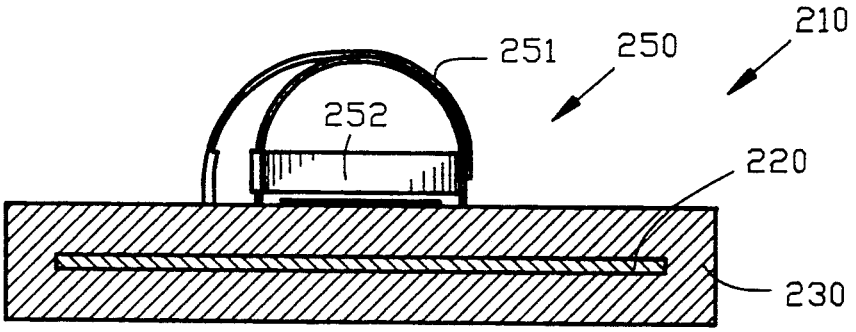
FIG. 13 is a sectional view along line 13—13 in FIG. 12.

FIGS. 12 and 13 are sectional views of a third embodiment of an aquatic exercise device 210 of the present invention comprising a restraining member 220. A flotation means 230 is formed about the restraining member 220 for defining a front portion 221, an intermediate portion 222 and a rear portion 223. The restraining member 220 is formed of an unitary rigid polymeric material such as polyethylene having a thickness of one eight of an inch. Preferably, the floatation member 230 is molded about the restraining means 220 which may be in the form of a closed cell polyethylene foam having a thickness of one inch. The front portion 221 and intermediate portion 222 are enlarged relative to the rear portion 223 in a manner similar to the shape of the first embodiment of the aquatic exercise device 10 shown in FIGS. 1-9.

The aquatic device 210 includes foot securing means 250 for securing the restraining member 120 to the foot 12 of the user. The foot securing means 250 comprises a first and a second foot securing means 251 and 252 with the first foot securing means 251 extending over the instep 12A of the foot 12 whereas a second foot securing means 252 extends about the heel 12B of the foot 12. The first and second foot securing means 251 and 252 are similar to the arrangement shown in FIGS. 1-9.

The restraining member 220 includes a plurality of through apertures 260 defined in the intermediate portion 222 of the restraining member 220. The intermediate apertures 260 comprise inner elongated apertures 261A and 261B, central elongated apertures 262A and 262B and outer elongated apertures 263A and 263B.

Figure 14:
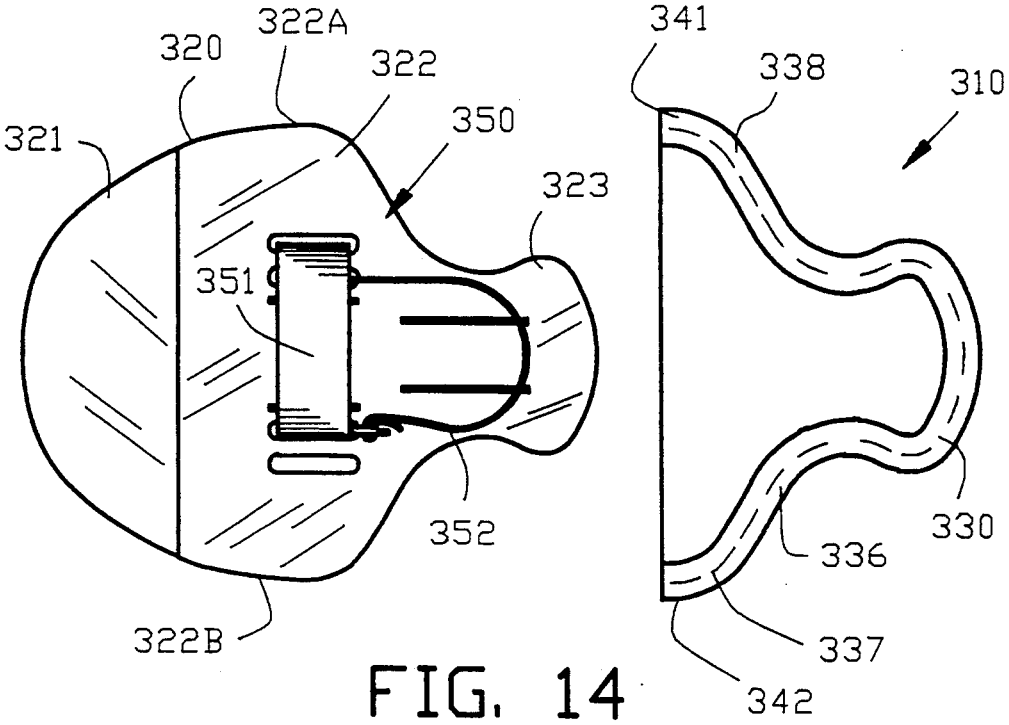
FIG. 14 is an exploded view of a portion of a fourth embodiment of an aquatic exercise device of the present invention.
Figure 15:
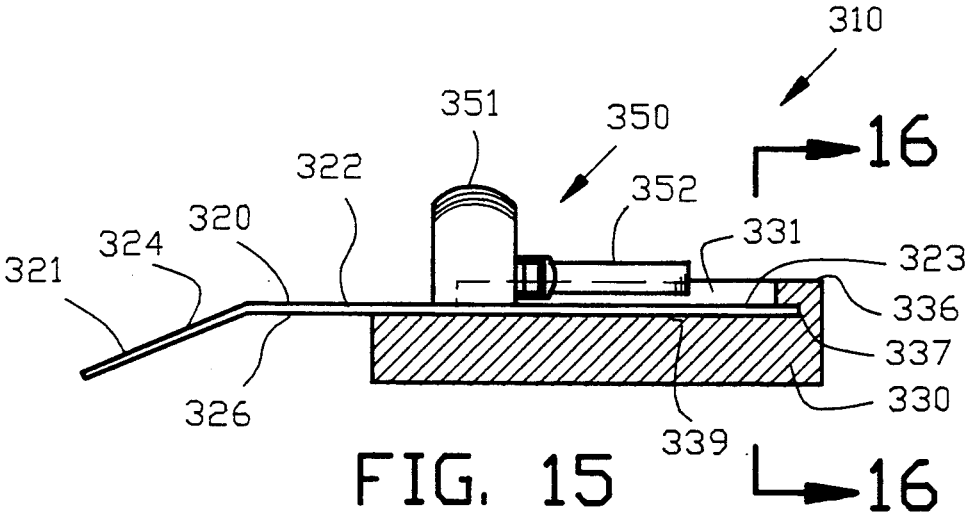
FIG. 15 is a side sectional view of the fourth embodiment of an aquatic exercise device of the present invention.
Figure 16:
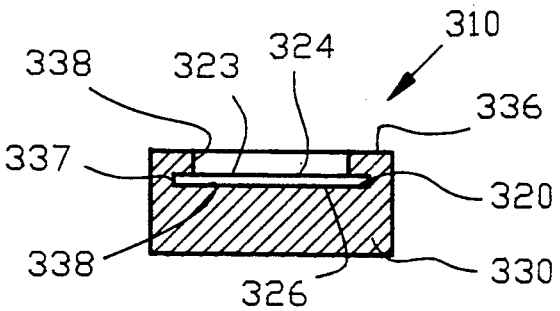
FIG. 16 is a sectional view along line 16—16 in FIG. 15.

FIG. 14 illustrates an exploded view of a fourth embodiment of an aquatic exercise device 310 of the present invention comprising a restraining member 320 defining a front portion 321, an intermediate portion 322 and a rear portion 323. FIGS. 15 and 16 illustrate sectional views of FIGS. 14 and 15, respectively. The restraining member 320 defines a upper surface 324 and a bottom surface 326. The aquatic exercise device 310 includes flotation means 330 which will be described in greater detail hereinafter.

The aquatic device 310 includes foot securing means 350 comprising a first and a second foot securing means 351 and 352 with the first foot securing means 351 extending over the instep of a foot whereas a second foot securing means 352 extends about a heel 12B of a foot. The foot securing means 350 is secured to the restraining member 320 in a manner similar to FIGS. 1-13.

The restraining member 320 is shown in the first embodiment of the invention as being a substantially flat one-piece member formed of an unitary polymeric material with the front portion 321 of the restraining member 320 forming an angle relative to the intermediate portion 322.

The flotation means 330 is preferably formed from a resilient material. The flotation means 330 has an opening 331 in an upper surface 336 with a groove 337 being defined between a projection 338 and a base surface 339. The projection 338 defines a first and a second end 341 and 342 for resiliently grasping the restraining member 320 at side portions 322A and 322B.

FIGS. 15 and 16 illustrate the flotation means 330 secured to the restraining member 320 with the upper surface 324 and the bottom surface 326 of the restraining member 320 engaging opposed sides of the groove 337 and with the bottom surface 326 of the restraining member 320 engaging the base surface 339 of the floatation means 330. The flotation means 330 is maintained on the restraining member 320 by the first and second ends 341 and 342 of the projection 338 resiliently grasping the side portions 322A and 322B of the restraining member 320. The resiliently securing of the flotation means 330 on the restraining member 320 enables the flotation means 330 to be readily removed from the restraining member 320.

The present disclosure includes that contained in the appended claims as well as that of the foregoing description. Although this invention has been described in its preferred that the present disclosure of the preferred form has been made only by way of example and that numerous changes in the details of construction and the combination and arrangement of parts may be resorted to without departing from the spirit and scope of the invention.

What is claimed is:

1. An improved aquatic exercise device for a user immersed in water, comprising in combination:

a restraining member having a top surface and a bottom surface;

said restraining member defining a front portion, an intermediate portion and a rear portion;

flotation means;

means for securing said flotation means to said restraining member;

means for securing said restraining member to a foot of a user to enable said restraining member to restrain the foot movement of the user and with said flotation means to partially supporting the user in the water; and said means for securing said flotation means to said restraining member including said restraining member being encompassed by said flotation means.

2. An improved aquatic exercise device as set forth in claim 1, wherein said restraining member is a substantially flat one piece member.

3. An improved aquatic exercise device as set forth in claim 1, wherein said front portion of said restraining member is enlarged relative to said rear portion of said restraining member.

4. An improved aquatic exercise device as set forth in claim 1, wherein said flotation means comprises a closed cell foam material.

5. An improved aquatic exercise device as set forth in claim 1, wherein said means for securing said flotation means to said restraining member includes said flotation means having plural grooves defined therein for slidably receiving terminating edges of said restraining member.

* * * * *